US007719507B2

(12) United States Patent
Okumura et al.

(10) Patent No.: US 7,719,507 B2
(45) Date of Patent: May 18, 2010

(54) LIQUID CRYSTAL DISPLAY CONTROLLER AND LIQUID CRYSTAL DISPLAY CONTROL METHOD

(75) Inventors: Haruhiko Okumura, Fujisawa (JP); Tetsuro Itakura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1052 days.

(21) Appl. No.: 11/399,419

(22) Filed: Apr. 7, 2006

(65) Prior Publication Data

US 2007/0046612 A1 Mar. 1, 2007

(30) Foreign Application Priority Data

Aug. 31, 2005 (JP) ..... P2005-251946

(51) Int. Cl.
*G09G 3/36* (2006.01)

(52) U.S. Cl. ..... 345/98; 345/87

(58) Field of Classification Search ..... 345/204, 345/213, 214, 98, 30, 55, 84, 87
See application file for complete search history.

(56) References Cited

U.S. PATENT DOCUMENTS 6,344,850 B1 2/2002 Okumura et al.
6,407,732 B1 * 6/2002 Stiens et al. ..... 345/204
6,424,328 B1 7/2002 Ino et al.
6,819,308 B2 * 11/2004 Cheng ..... 345/76
6,900,781 B1 5/2005 Mori et al.
6,922,180 B2 * 7/2005 Iwami et al. ..... 345/60

FOREIGN PATENT DOCUMENTS

| | | |
|---|---|---|
| EP | 1 152 387 A1 | 11/2001 |
| JP | 3-51887 | 3/1991 |
| JP | 6-89080 | 3/1994 |
| JP | 11-327518 | 11/1999 |
| JP | 2000-148093 | 5/2000 |
| JP | 2001-75528 | 3/2001 |
| JP | 2002-108288 | 4/2002 |
| JP | 2002-132213 | 5/2002 |

OTHER PUBLICATIONS

Nikkei Electronics, pp. 123-148, (Mar. 11, 1997).
Okumura, et al., "P.53: Vertically Differential EMI Suppression Method for High-resolution LCDs," International Display Research Conference (IDRC) '03 Digest, pp. 1-4, (2003).

* cited by examiner

*Primary Examiner*—Richard Hjerpe
*Assistant Examiner*—Sahlu Okebato
(74) *Attorney, Agent, or Firm*—Finnegan, Henderson, Farabow, Garrett & Dunner, L.L.P.

(57) ABSTRACT

A liquid crystal display controller includes a circuit which generates a signal for driving a signal line with the polarity of the signal controlled by a control signal; an inductance element into which current flows in synchronization with the control signal; and a switching unit which connects selectively one of the inductance element and the circuit to the signal line. The signal line of a liquid crystal display device is driven by the inductance element, whereby the power consumption is reduced.

18 Claims, 8 Drawing Sheets

LIQUID CRYSTAL DISPLAY CONTROLLER AND LIQUID CRYSTAL DISPLAY CONTROL METHOD

CROSS-REFERENCE TO THE INVENTION

This application is based upon and claims the benefit of priority from the prior Japanese Patent Application No. 2005-251946, filed on Aug. 31, 2005; the entire contents of which are incorporated herein by reference.

BACKGROUND OF THE INVENTION

1. Field of the invention

The present invention relates to a liquid crystal display controller and a liquid crystal display control method each of which controls a liquid crystal display device.

2. Description of the Related Art

In the liquid crystal display device, the polarity of the voltage to be applied to a liquid crystal is periodically inverted to prevent deterioration in characteristics (polarity inversion driving). In the polarity inversion driving, signal line inversion driving is performed in which the polarity of a signal is inverted for a signal line (for example, Japanese Patent Laid-open Application No. HEI 3-51887).

SUMMARY OF THE INVENTION

The signal line inversion driving of the liquid crystal display device consumes much power for the polarity inversion, so that the power consumption required for the driving is apt to increase.

In consideration of the above circumstances, an object of the present invention is to provide a liquid crystal display controller and a liquid crystal display control method each of which reduces the power consumption in signal line inversion driving of a liquid crystal display device.

A liquid crystal display controller according to an aspect of the present invention includes a circuit which outputs a signal for driving a signal line of a liquid crystal display with a polarity of the signal controlled by a control signal; an inductance element into which current flows in synchronization with the control signal; and a switching unit which switches between the inductance element and one of the circuit to connect the inductance element and the circuit to the signal line.

A liquid crystal display control method according to an aspect of the present invention includes generating by a circuit a signal for driving a signal line of a liquid crystal display with a polarity of the signal controlled by a control signal; flowing a current into an inductance element in synchronization with the control signal; and connecting selectively one of the inductance element and the circuit to the signal line by a switching unit.

BRIEF DESCRIPTION OF THE DRAWINGS

FIG. 3 is a timing chart showing details of variations with time in a resonance control signal and so on.

DESCRIPTION OF THE EMBODIMENTS

Hereinafter, embodiments of the present invention will be described in detail with reference to the drawings.

First Embodiment

Figure 1:
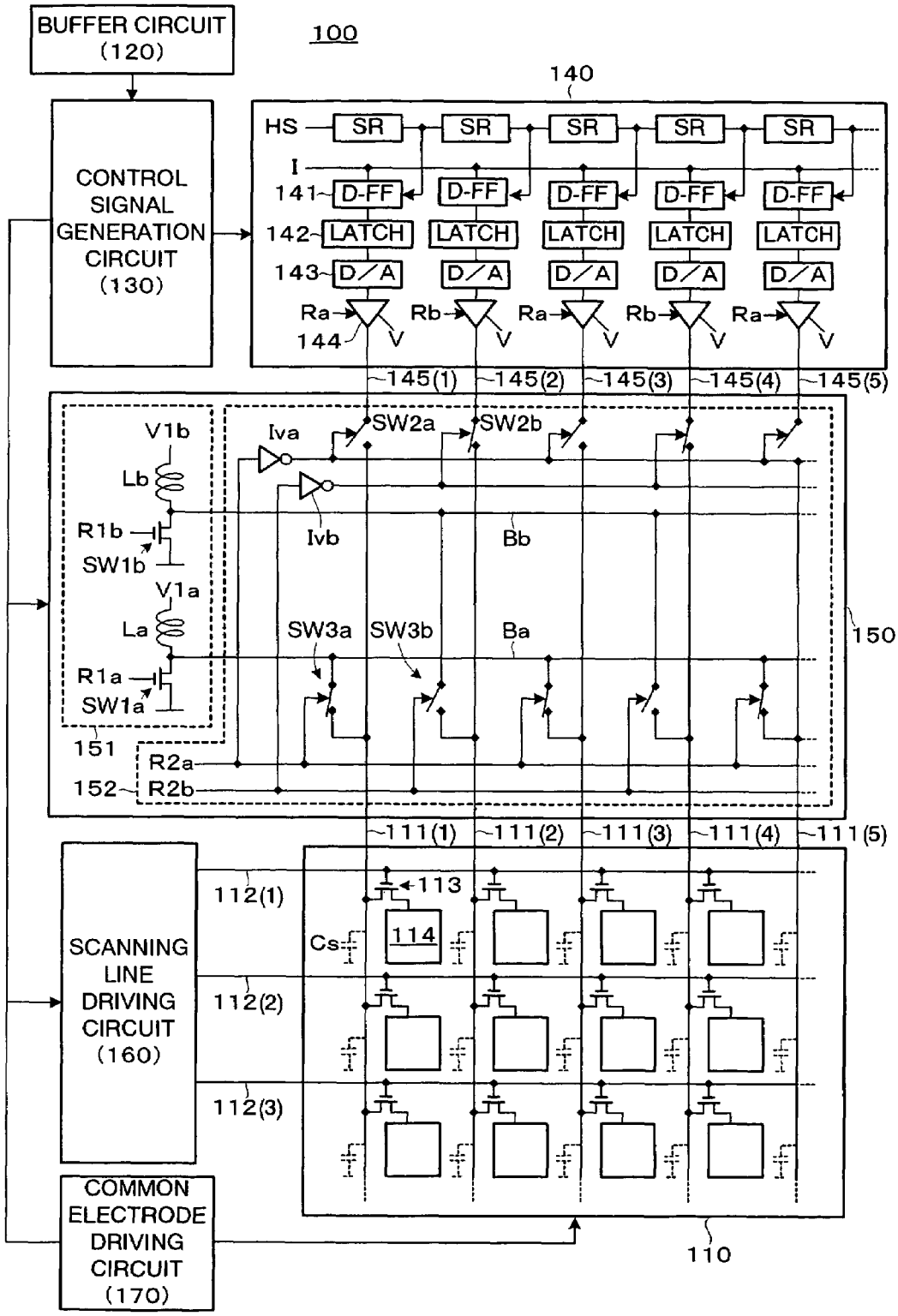
FIG. 1 is a diagram showing a liquid crystal display apparatus according to a first embodiment of the present invention.

FIG. 1 is a diagram showing a liquid crystal display apparatus 100 according to a first embodiment of the present invention.

The liquid crystal display apparatus 100 includes a display unit (liquid crystal display device) 110, a buffer circuit 120, a control signal generation circuit 130, a signal line driving circuit (signal line driver) 140, a signal line drive switching circuit 150, a scanning line driving circuit (gate driver) 160, and a common electrode driving circuit (common driving circuit) 170.

The liquid crystal display apparatus 100 drives the display unit 110 in a polarity inversion manner. At the beginning of the polarity inversion, inductance elements L (La, Lb) of the signal line drive switching circuit 150 resonantly drive the display unit 110. The signal line driving circuit 140 then drives the display unit 110 according to respective target driving voltages at signal lines 111.

The display unit 110 includes signal lines 111 (111(1), 111(2), and so on), scanning lines 112 (112(1), 112 (2), and so on), switching elements 113, and pixel electrodes 114.

The signal lines 111 which transmitted image signals are driven by the signal line driving circuit 140. Note that capacities (signal line capacities) Cs of the signal lines 111 are shown by broken lines.

In this embodiment, adjacent signal lines 111 are driven with inverted polarities (in an inversion driving system) and their polarities are inverted for every scanning line 112 (in a dot inversion driving system). In the dot inversion driving system, the display unit 110 is driven as follows. For example, it is assumed that odd-numbered signal lines 111 (111(1), 111(3), 111 (5), and so on) are driven with a positive polarity and even-numbered signal lines 111 (111(2), 111 (4), and so on) are driven with a negative polarity in a field on a scanning line 112(*i*). In this case, on the next scanning line 112(*i*+1), the polarities of the signal lines 111 are inverted such that the odd-numbered signal lines 111 are driven with the negative polarity and the even-numbered signal lines are driven with the positive polarity. Further, the polarities of the signal lines 111 are inverted also in the next field.

Note that the inversion of the polarities of the signal lines 111 is realized by controlling later-described buffer amplifiers 144 with polarity inversion signals Ra and Rb.

The scanning lines (gate lines) 112 which transmit scanning line signals are arranged perpendicular to the signal lines 111 and driven by the scanning line driving circuit 160.

The switching elements 113 are, for example, thin film transistors (TFT) arranged near intersections of the signal lines 111 and the scanning lines 112, and control the pixel electrodes 114 in response to signals from the signal lines 111 and the scanning lines 112.

Opposed to the pixel electrodes 114, a common electrode is disposed, so that a liquid crystal between the pixel electrodes 114 and the common electrode is driven by the voltages between the pixel electrodes 114 and the common electrode. Consequently, by controlling the voltages of the pixel electrodes 114, images are displayed on the display unit 110.

The buffer circuit 120 is a circuit that reduces noises and waveform-shapes for an inputted image signal and supplies a stable signal to the control signal generation circuit 130.

The control signal generation circuit 130 receives the image signal inputted from the buffer circuit 120 and generates signals to control the signal line driving circuit 140, the signal line drive switching circuit 150, the scanning line driving circuit 160, and the common electrode driving circuit 170 and outputs the control signals to them. The control signal generation circuit 130 can be composed of a gate array.

The signal line driving circuit 140 which is a driving circuit for driving the signal lines 111 includes shift registers SR, D-FFs (flip-flops) 141, latch circuits 142, D/A conversion circuits 143, buffer amplifiers 144, and wirings 145 (145(1), 145(2), and so on). Note that signal line driving circuits 140 are classified into a digital system and an analog system, and the signal line driving circuit 140 of the digital system is exemplified herein.

The shift register SR generates, from a horizontal synchronization signal HS, a sampling instruction signal for instructing a sampling time of an image signal I.

The D-FF 141 samples the image signal I in response to the sampling instruction signal from the shift register SR. As a result, the image signal I is converted from a serial signal to a parallel signal.

The latch circuit 142 latches a digital signal inputted thereto and holds it during one horizontal period.

The D/A conversion circuit 143 is a conversion circuit which converts the digital signal into an analog signal.

The buffer amplifier 144 is an output buffer which outputs, to the wiring 145, the image signal (signal line driving signal) that drives the signal line 111. The buffer amplifier 144 controls the positive or negative polarity of its output according to the polarity inversion signal Ra or Rb (polarity inversion control). Selection of a power supply voltage V controls the output polarity.

In this event, the polarity inversion signals Ra and Rb which are different in phase by about 180° from each other are inputted to the buffer amplifiers 144 corresponding to the odd-numbered and the even-numbered signal lines 111, respectively. This is because the polarities of the signals are different between the adjacent signals lines 111 (inverse polarities).

The signal line drive switching circuit 150 is a circuit for switching between the signal line driving circuit 140 and the inductance elements L to drive the signal lines 111. The details will be described later.

The scanning line driving circuit 160 is a driving circuit for driving the scanning lines 112.

The common electrode driving circuit 170 is a driving circuit for driving the common electrode of the display unit 110. (Details of Signal Line Drive Switching Circuit 150)

Hereinafter, the details of the signal line drive switching circuit 150 will be described.

The signal line drive switching circuit 150 includes an inductance resonant unit 151 and a drive switching unit 152.

The inductance resonant unit 151 which stores power by resonating the inductance elements La and Lb includes the inductance elements L (La, Lb) and switch elements SW1 (SW1*a*, SW1*b*). Note that "a" and "b" which are subscripts to the inductance elements L and the switch elements SW1 correspond to the odd-numbered and the even-numbered signal lines 111, respectively.

The inductance elements L (La, Lb) store power fed from the power supplies V (Va, Vb) to drive the odd-numbers and the even-numbered signal lines 111, and their resonant states are controlled by the switch elements SW1 (SW1*a*, SW1*b*). These voltages V can be, for example, positive constant voltages.

As has been described, since the adjacent signal lines 111 are driven by signals with inverse polarities, the inductance elements La and Lb are connected to the odd-numbered and the even-numbered signal lines 111 via common buses respectively such that the signal lines 111 with the same polarity can be driven as a group. In short, two groups of the signal lines 111 can be formed in each of which the signal lines 111 have the same polarity.

It is preferable that a resonant frequency determined by inductance amounts of the inductance elements La and Lb and total capacities Ca and Cb of the odd-numbered and the even-numbered signal lines 111 substantially matches with the driving frequency of the liquid crystal display apparatus 100. Efficient driving the capacities C (Ca, Cb) by the energy stored in the inductance elements L (La, Lb) easily reduces the power consumption. In this event, the inductance elements L and the capacities C form a resonant circuit. More specifically, driving the signal lines 111 by the inductance elements L resonating with the signal line capacities C reduces the power consumption of the liquid crystal display apparatus 100.

Herein, the two inductance elements L (La, Lb) (two resonant circuits) drive the odd-numbered and the even-numbered signal lines 111 respectively. In contrast to the above, it is also possible that one inductance element L (one resonant circuit) is switched in time division to drive the odd-numbered and the even-numbered signal lines 111. In this case, it is preferable that the capacities Ca and Cb of the odd-numbered and the even-numbered signal lines 111 are substantially the same, that is, the numbers of the odd-numbered and the even-numbered signal lines 111 are the same.

The switch elements SW1 are switches which repeat ON/OFF in the polarity inversion cycle, for which, for example, MOS transistors (TFTS) formed of polysilicon film can be employed. The switch elements SW1*a* and SW1*b* are driven by resonance control signals R1*a* and R1*b* with polarities substantially inverse to each other to control the resonant states of the inductance elements La and Lb.

When the switch elements SW1 are turned on, the inductance elements L and the common buses B (Ba, Bb) are connected to ground, whereby current flows from the power supplies V into the inductance elements L so that power is stored therein. In this event, if switch elements SW3 are ON, the signal lines 111 are also connected to the ground so that the signal lines 111 have the negative polarity with respect to the common electrode Vcc.

Contrarily, the switch elements SW1 are turned off, the power stored in the inductance elements L flows to the common buses B. In this event, if the switch elements SW3 are ON, the power flows into the signal lines 111 so that the signal lines 111 have the positive polarity.

The drive switching unit 152, which switches connection to the signal lines 111 between the signal line driving circuit 140 and the inductance resonant unit 151, includes switch elements SW2 (SW2*a*, SW2*b*) and SW3 (SW3*a*, SW3*b*) and inverters Iv (Iva, Ivb). Note that subscripts "a" and "b" to the switch elements SW2 and SW3 and the inverters Iv correspond to the odd-numbered and the even-numbered signal lines 111 respectively, and they are controlled by switching control signals R2*a* and R2*b* with polarities substantially inverse to each other.

The switch elements SW2 and SW3 are configured such that when one of them is ON, the other is OFF, so as to select which one of the signal line driving circuit 140 and the inductance resonant unit 151 is connected to the signal lines 111.

The switch elements SW2 are switches disposed between the wirings 145 of the signal line driving circuit 140 and the signal lines 111. The switch elements SW2 are driven by the switching control signals R2 (R2*a*, R2*b*) and turned on/off in the polarity inversion cycle.

The switch elements SW3 are switches disposed between the inductance elements La and Lb and the signal lines 111. The switch elements SW3 are driven by the resonance control signals R1 (R1*a*, R1*b*) and turned on/off in the polarity inversion cycle.

Note that, for the switch elements SW2 and SW3, for example, MOS transistors (TFTS) formed of polysilicon film can be employed. (Power Consumption in Liquid Crystal Display Apparatus)

First, what factors determine the power consumption of a liquid crystal display apparatus 100*x* where switching of driving by the signal line drive switching circuit 150 is not performed will be discussed. Note that the power consumption shall not include the power consumption by bias current flowing in a DC manner.

(1) Signal Line Driving Circuit

Since the main factors determining the power consumption of the signal line driving circuit 140 are the latch circuits 142 and the buffer amplifiers 144, only these two factors will be considered.

The maximum power consumption P1 of the latch circuits 142 is expressed by the following expression (1) where the input equivalent capacity relating to the image signal is C1, the input equivalent capacity relating to the sampling clock is Cck, and the frequency of the image sampling clock is fs.

$$P1=(C1+2*Cck)*(fs/2)*V1^2 \quad (1)$$

The maximum power consumption Pob of the buffer amplifiers 144 is expressed by the following expression (2) where the signal line capacity is Cs, the horizontal driving frequency is fh, and the number of horizontal pixels is Nh.

$$Pob=Nh*Cs*fh*VS^2/2 \quad (2)$$

(2) Buffer Circuit

The buffer circuit 120 may be omitted in some cases but is considered here because it is basically necessary. The maximum power consumption Pb of the buffer circuit 120 is expressed by the following expression (3) where the input equivalent capacity of the circuit relating to the sampling clock is Cbc and the input equivalent capacity of the circuit relating to the image signal is Cbp.

$$Pb=(2*Cbc+Cbp)*(fs/2)*Vb^2 \quad (3)$$

(3) Control Signal Generation Circuit

The control signal generation circuit 130 has different frequencies therein depending on signals, and its power consumption for the image sampling clock fs is considered to be a main important factor. Therefore, the maximum power consumption Pga of the whole control signal generation circuit 130 is expressed by the following expression (4) where the equivalent internal capacity of the circuit relating to the sampling clock is Cgac and the input equivalent capacity of the circuit relating to the image signal is Cgap.

$$Pga=(2*Cgac+Cgap)*(fs/2)*Vga^2 \quad (4)$$

(4) Common Electrode Driving Circuit

The common electrode driving circuit 170 is for driving the capacity Cc of the common electrode, and its power consumption relating to the sampling clock fs can be considered to be an important factor. Therefore, the maximum power consumption Pc of the whole common electrode driving circuit 170 is expressed by the following expression (5).

$$Pc=Cc*fs*Vc^2 \quad (5)$$

(5) Scanning Line Driving Circuit

The scanning line driving circuit 160 is for driving the capacities Cg of the scanning lines (gate lines) 112, and its maximum power consumption Pg is expressed by the following expression (6) where the driving frequency of the gate line is fg (usually the horizontal driving frequency fh).

$$Pg=Cg*fg*Vg^2 \quad (6)$$

(6) Power Consumption of Whole Liquid Crystal Display Apparatus 100*x* where Switching of Driving by Signal Line Drive Switching Circuit 150 is Not Performed.

From the above, the power consumption Pall of the whole liquid crystal display apparatus 100*x* is expressed by the following expression.

$$\begin{aligned}\text{Pall} &= P1 + Pob + Pb + Pga + Pc + Pg \\ &= (C1 + 2*Cck)*(fs/2)*\text{V}1^2 + \\ &\quad Nh*Cs*fh*\text{V}s^2/2 + \\ &\quad (2*Cbc + Cbp)*(fs/2)*\text{V}b^2 + \\ &\quad (2*Cgac + Cgap)*(fs/2)*\text{V}ga^2 + \\ &\quad Cc*fs*\text{V}c^2 + Cg*fh*\text{V}g^2\end{aligned}$$

Assuming that the common electrode is at a constant voltage and Nh*Cs>>Cg, the following expression is obtained.

$$\begin{aligned}\text{Pall} &= (C1 + 2*Cck + 2*Cbc + Cbp + 2*Cgac + Cgap)* \\ &\quad (fs/2)*V^2 + Nh*Cs*(fh/2)*V^2 \\ &= \text{Pall}(C, f, \text{V})\end{aligned} \quad (7)$$

As described above, the power consumption Pall of the whole liquid crystal display apparatus 100*x* is expressed by the relation between the capacity C, the driving frequency f (the horizontal frequency and the image clock frequency), and the voltage V.

The power consumption of the digital signal processing system is relatively easily reduced by reducing the power supply voltage. On the other hand, the driving voltage of the liquid crystal itself is not easily reduced. In addition, due to an increase in the number of pixels, the driving frequency tends to increase. For this reason, the power for driving the signal lines 111 is apt to increase.

The inversion control of the signal lines 111 further increases the power consumption at the signal lines 111. In particular, for the case of dot inversion, the polarities of the signal lines 111 have to be inverted for every scanning line 112. In this case, the horizontal driving frequency fh in the expression (2) is high to be 30 kHz to 60 kHz or higher for the number of signal lines in a High Vision or SXGA class, leading to further increase in power consumption.

(Operation of Signal Line Drive Switching Circuit 150)

The operation of the signal line drive switching circuit 150 will be described.

When driving the signal lines 111, the switch elements SW2 and SW3 initially select the inductance elements L. When the voltages of the signal lines 111 rise to be close to the target voltages, the switch elements SW2 and SW3 select the signal line driving circuit 140. Thereafter, the selection of the signal line driving circuit 140 is continued until the voltages reach the target voltages so that the signal lines 111 are driven by the signal line driving circuit 140.

More specifically, it will be discussed to invert either group (signal line group) of the odd-numbered or the even-numbered signal lines 111 from the negative polarity to the positive polarity.

(1) The signal line group with the negative polarity is driven to have the positive polarity by resonant driving by electromagnetic energy stored in the inductance elements L.

(2) Thereafter, the switch elements SW2 and SW3 are switched, so that the signal lines 111 are individually driven by the signal line driving circuit 140. This is because the voltages for driving the signal lines 111 are different depending on respective images. As a result, the signal lines 111 are controlled to the target voltages according thereto.

Such a hybrid driving by the signal line drive switching circuit 150 enables both maintenance of the voltage accuracy of the liquid crystal display apparatus 100 and reduction in the power consumption.

Note that when either group of the odd-numbered and the even numbered signal lines 111 (signal line group) is inverted from the positive polarity to the negative polarity, the switch elements SW1 are turned on to drive the signal lines 111 to the negative polarity and store energy in the inductance elements L.

A. Timing Chart

Figure 2:
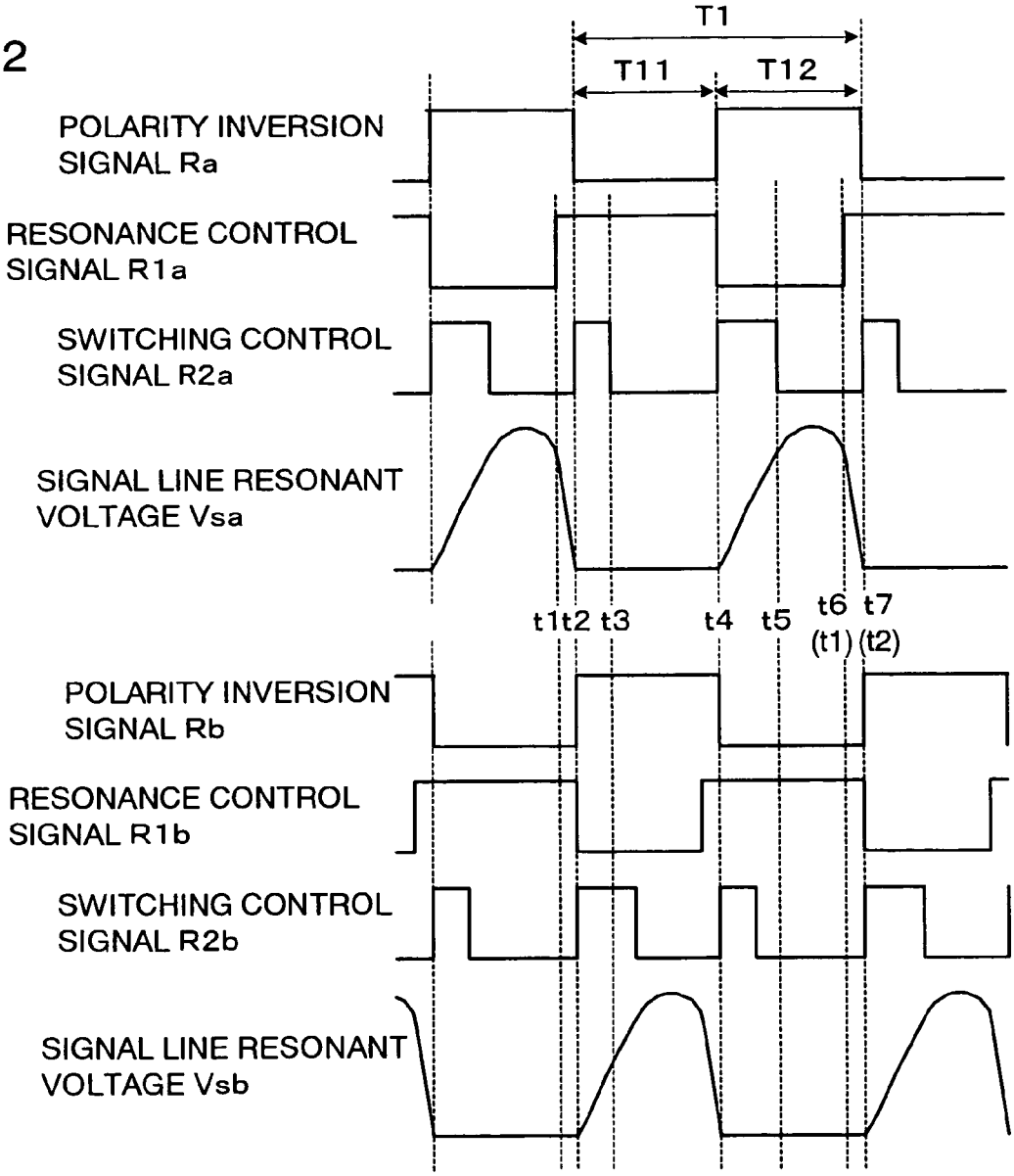
FIG. 2 is a timing chart showing variations with time in polarity inversion signals and so on in a corresponding manner.

FIG. 2 is a timing chart showing variations with time in the polarity inversion signals R (Ra, Rb), the resonance control signals R1 (R1*a*, R1*b*), the switching control signals R2 (R2*a*, R2*b*), and signal line resonant voltages Vs (Vsa, Vsb) in a corresponding manner.

The signal line resonant voltages Vs (Vsa, Vsb) mean voltages applied by the inductance elements La and Lb to the odd-numbered and the even-numbered signal lines 111.

Since all of the polarity inversion signals R, the resonance control signals R1, and the switching control signals R2 are repeated at intervals of a polarity inversion period T1, they are substantially synchronized with each other. The polarity inversion signals R, the resonance control signals R1, and the switching control signals R2 drive the signal lines 111 and control the signal line resonant voltages Vs. Note that although positive and negative periods T12 and T11 of the polarity inversion signals R are made equal in this chart, these periods can also be intentionally made different.

In the signal line drive switching circuit 150, the following sequence is repeated.

When the resonance control signals R1 are "H", the switch elements SW1 are turned on, whereby current flows from the power supplies Va and Vb to the inductance elements La and Lb and stored as electromagnetic energy (times t1 to t4 in FIG. 2).

When the resonance control signals R1 are "L", the switch elements SW1 are turned off. In this event, the current stored in the inductance elements La and Lb flows, as the resonant current with the equivalent capacities Cse of the signal lines 111, to the signal lines 111 (Cse) side. As a result, the signal line voltage Vsa rises (times t4 to t6 in FIG. 2).

When the resonance control signals R1 are turned to "H" again, the switch elements SW1*a* returned on. In this event, charges stored on the signal lines 111 (Cse) flow as current to the ground GND, and current flows to the inductance elements La and Lb. As a result, the current is stored, as electromagnetic energy, in the inductance elements La and Lb.

Figure 3:
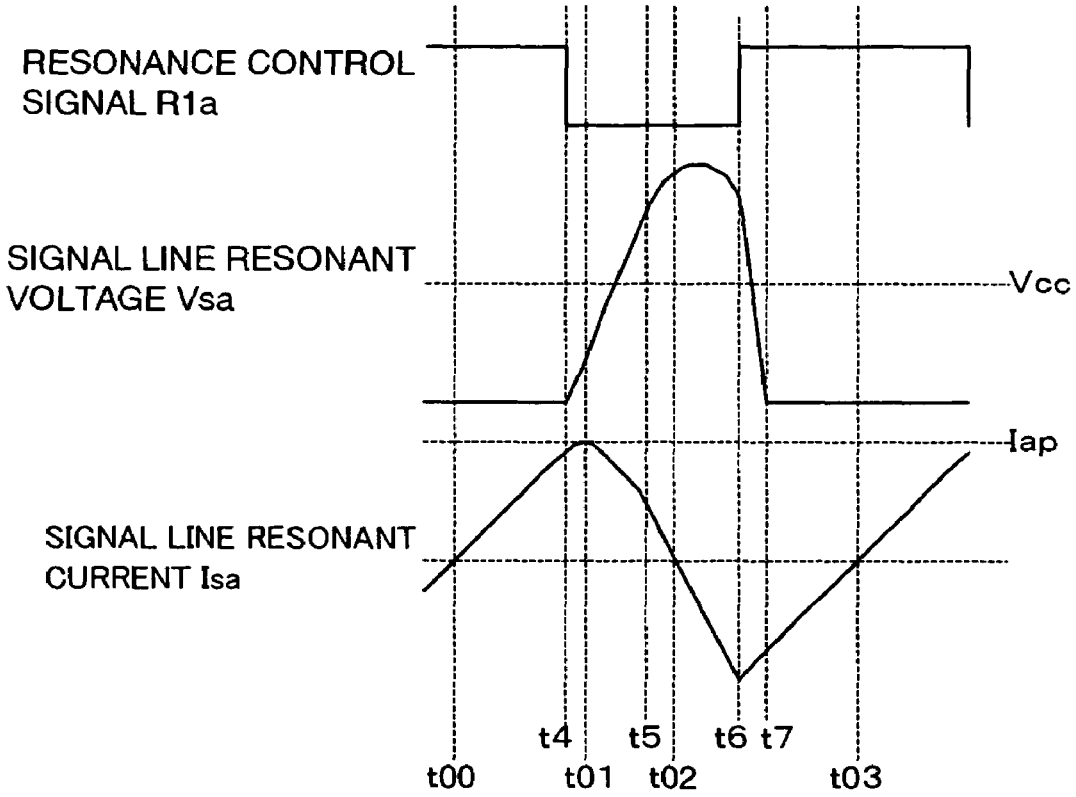

FIG. 3 is a timing chart showing details of variations with time in the resonance control signal R1*a*, the signal line resonant voltage Vsa, and a signal line resonant current Isa in a corresponding manner. Note that the signal line resonant current Isa means current flowing from inductance element La into the odd-numbered signal lines For the equivalent capacity Cse of the signal lines 111 seen from the inductance element L and the resonant frequency fr, the inductance amount L of the inductance element shall be defined here as ($L=1/((2*n*fr)^2*Cse)$).

(1) Times t00 to t4

The current I1 flowing through the inductance element La linearly increases. The current I1 at time t4 is expressed by the following expression.

$$I1=(1/L)*\int v(t)dt=V1a*(t4-t00)/L$$

Note that V1*a* indicates the power supply voltage fed to the inductance.

(2) Times t4 to t01

At time t4, the resonance control signal R1*a* is turned to "L", the switching control signal R2*a* is turned to "H", so that the switch elements SW1*a* and SW2*a* are turned off and the switch elements SW3*a* are turned on.

As a result, the current begins to flow from the inductance element La toward the signal lines 111 (capacities Cse). Since the voltage (Vsa-Vc) is positive, the current I1 flowing through the inductance element La increases and reaches the peak Iap at time t01.

(3) Times t01 to t02

The electromagnetic energy $(1/2)*Li*Iap^2$ stored in the inductance element L at time t01 gradually transfers to the equivalent capacities Cse with the resonant frequency fr. As a result, the voltage Vsa at the equivalent capacity Cse reaches the peak Vsap at time t02. In this event, the following expression is established.

$$(1/2)*L*I_{ap}^2=(1/2)*Cse*Vsap^2$$

$$Vsap=(L/C)^{1/2}*I_{ap}$$

Note that at time t5 at a midpoint between times t01 and t02, the switching control signal R2*a* is turned to "L", the switch elements SW2*a* and SW3*a* are turned on and of f, respectively. In other words, driving of the signal lines 111 is switched to the signal line driving circuit 140.

(4) Times t02 to t6

The electrostatic energy (½)*Cse*$V_{cp}^2$ stored in the equivalent capacity Cse at time t02 gradually transfers to the inductance element La. Since a period of times t00 to t6 corresponds to a half cycle of resonance, the power supply voltage V1*a* is not reached at time t6.

(5) Times t6 to t7

At time t6, the switch element SW1*a* is turned on, so that the charges stored in the equivalent capacity Cse flow to the ground GND according to the time constant of the ON-resistance of the switch element SW1*a* and the equivalent capacity Cse. At time t7, the voltage of the equivalent capacity Cse becomes 0V.

(6) Times t7 to t03

The current flowing from the power supply Va to the inductance element La linearly increases and reaches 0 A at time t03 (since the switch element SW1*a* is ON, the voltage of the equivalent capacity Cse stays 0V).

B. Power Consumption in Liquid Crystal Display Apparatus 100

In the resonant circuit comprising the equivalent capacity Cse of the signal lines 111 and the inductance elements L, the following differential expression is established.

$$L*(dI_L(t)/dt)+(1/Cse)*\int I_L(t)dt=V1a$$

By solving the above differential equation, the following expressions (11) and (12) are obtained.

$$vc(t)=V1a*(1-\cos\beta t+(\pi/2)*\sin\beta t) \quad (11)$$

$$I_L(t)=\beta*Cse*V1a\ (\sin\beta t+(\pi/2)*\cos\beta t) \quad (12)$$

Here, $\beta=1/(L*Cse)^{1/2}$

Since the flowing-out charge amount q and the flowing-in charge amount when the switch element SW1 is ON are equal, the power consumption $P_{reso}$ is expressed as follows:

$$\begin{aligned} P_{reso} &= f*q(t4)*V1a \\ &= f*Cse*vc(t4)*V1a \\ &= 2*f*Cse*V1a^2 \\ &= V1a^2/(\Pi(Cse/L)^{1/2}) \end{aligned}$$

In the liquid crystal display apparatus driven only by the buffer amplifiers 144 without using the signal line drive switching circuit 150, its power consumption $P_{buff}$ is expressed by the following expression where the power supply voltage is Vdd.

$$P_{buff}=f*Cse*Vdd^2 \quad (8)$$

Therefore, the power consumption reduction ratio E is expressed as follows:

$$\begin{aligned} E &= P_{reso}/P_{buff} \\ &= 2*f*Cse*V1a^2/(f*Cse*Vdd^2) \\ &= 2*V1a^2/Vdd^2 \end{aligned}$$

Accordingly, it is important point that to what extent the power supply voltage V1a can be decreased by the resonant driving. This can be calculated back by examining the voltage at time t02.

Since Iwa=$I_L$(t)=0 at time t02, the expression (13) is established from the expression (12).

$$0=\beta*Cse*V1a\ (\sin\beta t3+(\pi/2)*\cos\beta t02)$$

$$\sin\beta t02/\cos\beta t02=\tan\beta t02=-\pi/2$$

$$t02=1/(\beta\tan^{-1}(-\pi/2)) \quad (13)$$

The expression (13) is substituted for the expression (1).

$$\begin{aligned} vc(t3) &= V1a(1-\cos\beta t02+(\Pi/2)*\sin\beta t02) \\ &= Vdd \end{aligned}$$

$$V1a/Vdd = 1/(1-\cos\beta t02+(\Pi/2)*\sin\beta t02)$$

Accordingly the following expression (14) is established.

$$\begin{aligned} E &= 2*(V1a/Vdd)^2 \quad (14) \\ &= 2/(1-\cos\beta t3+(\Pi/2)*\sin\beta t3)^2 \end{aligned}$$

From the expressions (13) and (14), the power consumption reduction ratio E can be calculated. From the expression (13), β*t02=2.138[rad], which is substituted for the expression (14) so that the power consumption reduction ratio E is calculated.

E=1/4.1

Figure 4:
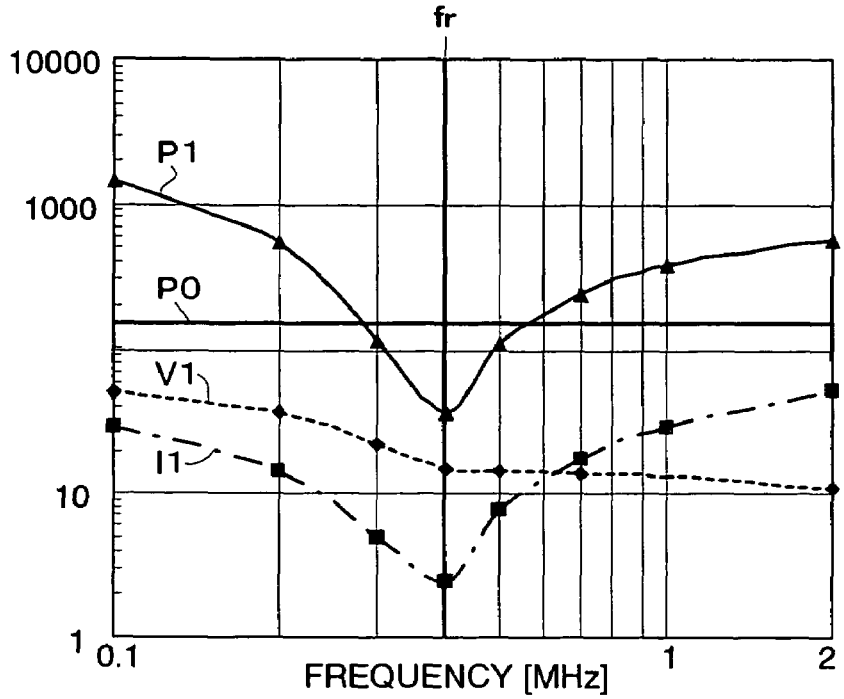
FIG. 4 is a graph showing the frequency dependence of voltage, current, and power consumption of the liquid crystal display apparatus.

FIG. 4 is a graph showing the frequency dependence of the voltage V1, the current I1, and the power consumption P1 in the liquid crystal display apparatus 100, compared to the power consumption P0 without using the signal line drive switching circuit 150. As shown in FIG. 4, the power consumption P1 can be reduced to about ¼ of the power consumption P0 at the resonant frequency fr.

As described above, driving by the inductance elements L resonating with the signal line capacities can reduce the power consumption required for the signal line driving to about ¼ or less. It is effective in the polarity inversion driving, particularly in the dot inversion driving.

(Modification)

As is evident from FIG. 2, a rise in voltage of the signal line 111 requires much time (times t4 to t5) during the resonant driving. On the other hand, a drop in voltage of the signal line 111 is relatively quick (times t6 to t7). In correspondence of the difference therebetween, it is conceivable to change the driving time depending on the polarity.

Figure 5:
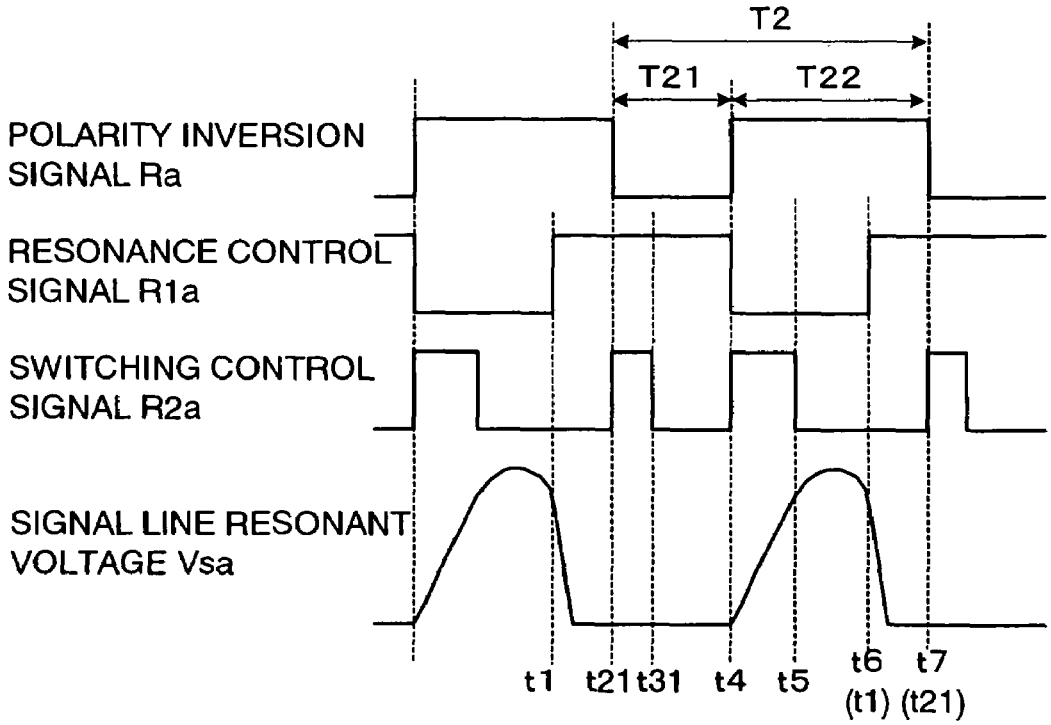
FIG. 5 is a timing chart showing variations with time in the polarity inversion signal and so on in a corresponding manner.

FIG. 5 is a timing chart showing variations with time in the polarity inversion signal Ra, the resonance control signal R1*a*, the switching control signal R2, and the signal line resonant voltage Vsa of a liquid crystal display apparatus 100*a* according to a modification of the first embodiment of the present invention in a corresponding manner.

Times t2, t3, and t7 in FIG. 2 are shifted to later times t21, t31, and t71. As a result of this, a period T22 of the positive polarity of the polarity inversion signal R is longer than a period T21 of the negative polarity. This shift assures a longer driving time even for the positive polarity, so as to decrease the possibility of shortage of the driving time.

Second Embodiment

A second embodiment of the present invention will be described.

Figure 6:
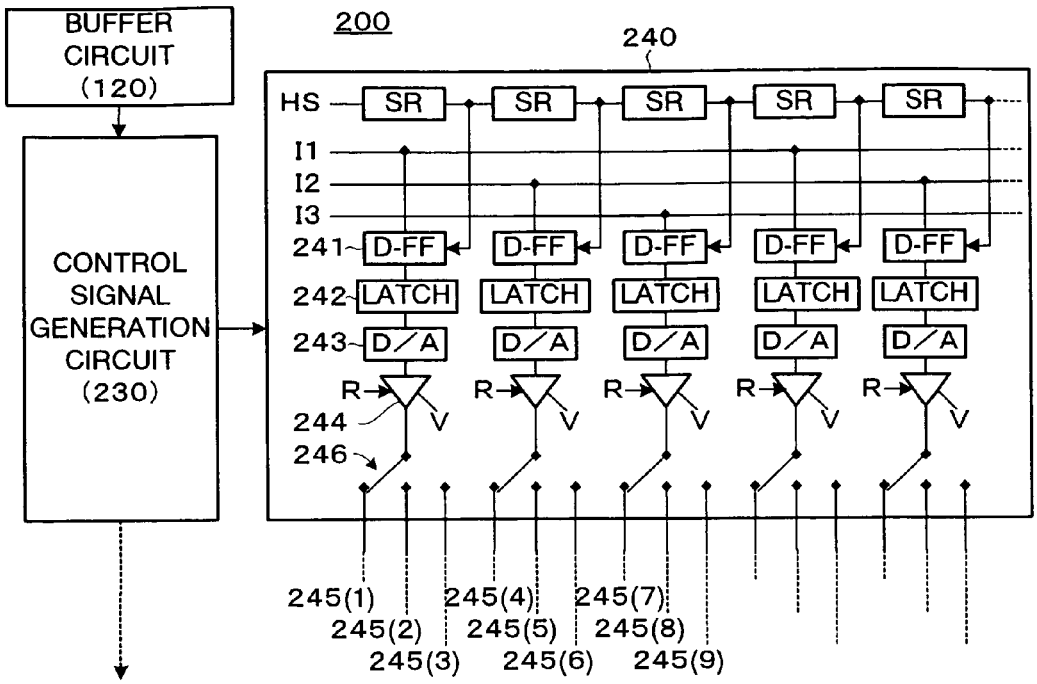
FIG. 6 is a diagram showing a part of a liquid crystal display apparatus according to a second embodiment of the present invention.
Figure 7:
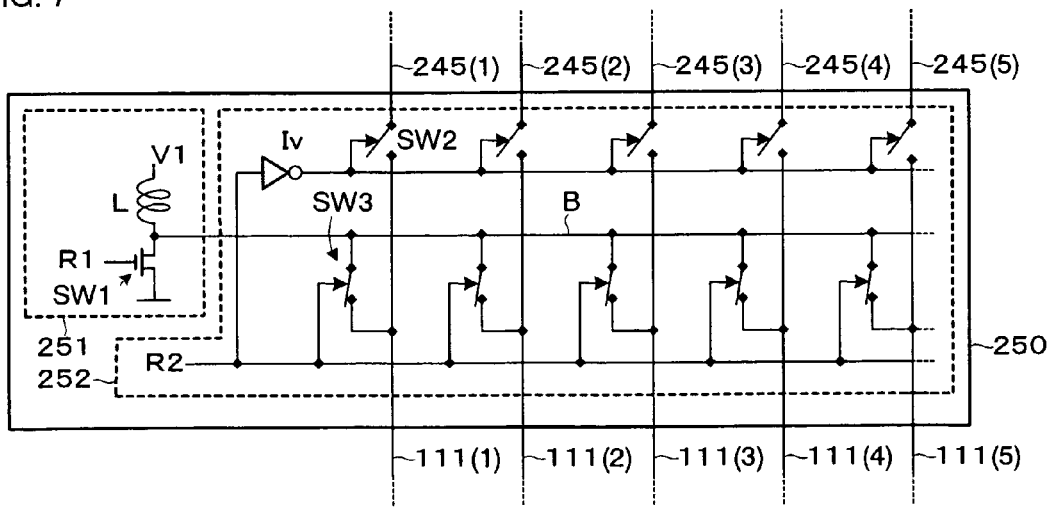
FIG. 7 is a diagram showing a signal line drive switching circuit of the liquid crystal display apparatus according to the second embodiment of the present invention.

FIG. 6 is a diagram showing a buffer circuit 120, a control signal generation circuit 230, and a signal line driving circuit 240 of a liquid crystal display apparatus 200 according to the second embodiment of the present invention. On the other hand, FIG. 7 is a diagram showing a signal line drive switching circuit 250 of the liquid crystal display apparatus 200. The liquid crystal display apparatus 200 includes a display unit 110, a scanning line driving circuit 160, and a common electrode driving circuit 170, which are the same as those of the liquid crystal display apparatus 100, and their illustration is omitted.

In the signal line driving circuit 240, each of switch elements 246 switches among three wirings 245 (for example, 245 (1) to 245 (3)) respectively corresponding to three signal lines 111 (for example, 111 (1) to 111 (3)) to output a signal line driving signal outputted from each of buffer amplifiers 244 to one of the wirings 245. In relation to this switching output, three image signals I1, I2, and I3 are sampled by three groups of shift registers SR and D-FFs 241 in a parallel manner. As a result, the image signal is divided into three parts for one horizontal line.

The buffer amplifier 244 selects the power supply voltage V in response to a polarity inversion signal R to control the positive or negative polarity of its output (polarity inversion control). Since the buffer amplifiers 244 are configured not to select signal lines 111 adjacent to each other, the polarity inversion signals R inputted into the buffer amplifiers 244 are the same.

As described above, the output of one buffer amplifier 244 is divided in time division to drive a plurality of signal lines 111. More specifically, the buffer amplifiers 244 drive the signal lines 111 with the signal lines 111 being divided every three lines into a first, a second, and a third signal line group. The first signal line group includes signal lines 111(1), 111 (4), 111(7), 111(10), and so on, the second signal line group includes signal lines 111(2), 111(5), 111(8), 111(11), and soon, and the third signal line group includes signal lines 111(3), 111(6), 111(9), 111(12), and so on.

The signal line drive switching circuit 250 is a circuit for switching between the signal line driving circuit 240 and an inductance element L to drive the signal lines 111 and includes an inductance resonant unit 251 and a drive switching unit 252. In correspondence to a single polarity inversion signal R in the signal line driving circuit 240, there is one each of inductance element L, switch elements SW1, SW2, and SW3, and inverter Iv.

(Operation of Liquid Crystal Display Apparatus 200)

Figure 8:
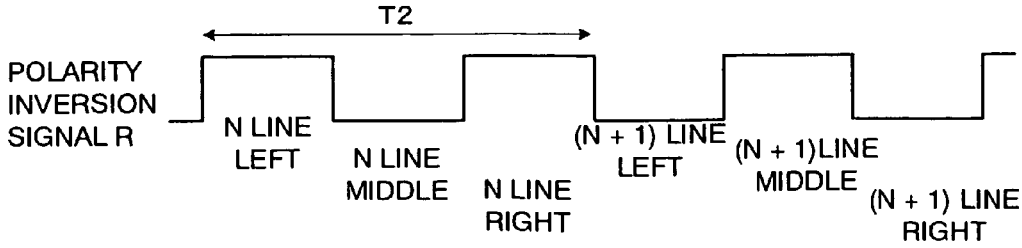
FIG. 8 is a diagram showing the correspondence between a polarity inversion signal and a selected signal line.

FIG. 8 is a diagram showing the correspondence between the polarity inversion signal R and a selected signal line 111.

When the first signal line group is selected by the signal line driving circuit 240 and driven with the positive polarity, the switch elements 246 are connected to the signal lines 111 on the left side. The switch elements 246 are then connected to the middle signal lines 111 so that the second signal line group is selected and driven with the negative polarity. The switch elements 246 are further connected to the signal lines 111 on the right side so that the third signal line group is selected and driven with the positive polarity. In this manner, pixels on one scanning line 112 are driven.

For the next scanning line 112, the switch elements 246 are connected to the signal lines 111 on the left side so that the first signal line group is selected and driven with the negative polarity. This is because if the first signal line group is driven again with the positive polarity, the polarities are discontinuous such as +−++−+. By starting to drive with the negative polarity, the continuity of the polarity inversion is maintained.

The signal line drive switching circuit 250 is controlled by a resonance control signal R1 and a switching control signal R2, which are substantially synchronization with the polarity inversion signal R, to switch connection to the signal lines 111 between the signal line driving circuit 240 and the inductance resonant unit 251.

In the liquid crystal display apparatus 200, the signal line capacity tends to decrease and the resonant frequency fr tends to increase. More specifically, the frequency f0 of the sampling clock is three times and the capacity of the signal lines 111 operated at a time becomes less than (to be one third) those of the liquid crystal display apparatus 100 with the same number of signal lines. Since the resonant frequency fr for the inductance element L and the signal line capacity C is proportional to −½th power of L*C, it is necessary to reduce the inductance amount of the inductance element L to ⅓ in order to correspond the resonant frequency fr to the sampling clock frequency f0.

Third Embodiment

A third embodiment of the present invention will be described.

In the liquid crystal display apparatus 100 and 200, the signal line drive switching circuits 150 and 250 invert the polarities of the signal lines 111. In other words, the signal line driving circuits 140 and 240 do not invert the polarities of the signal lines 111, making it possible to narrow the ranges of the voltages outputted from the signal line driving circuits 140 and 240. As a result of this, the power supply voltages V of the buffer amplifiers 144 and 244 can be reduced.

For example, assuming that the signal lines 111 can be driven by the signal line drive switching circuits 150 and 250 from −5V to 5V, it is only required to drive them within the ranges of 5V to 10V and of −5V to −10V even though the driving signal is ±10V. Hence, in the signal line driving circuits 140 and 240, a power supply voltage Vdd is set to 10V, and a voltage Vss corresponding to GND is set to 5V for the positive polarity. On the other hand, for the negative polarity, the power supply voltage Vdd is set to −5V, and the voltage Vss is set to −10V. This setting ensures realization of a drive voltage range of ±10V by a driver with a 5V-withstand voltage. As a result of this, the power consumption in proportional to the second power of the power supply voltage is ¼.

Figure 9:
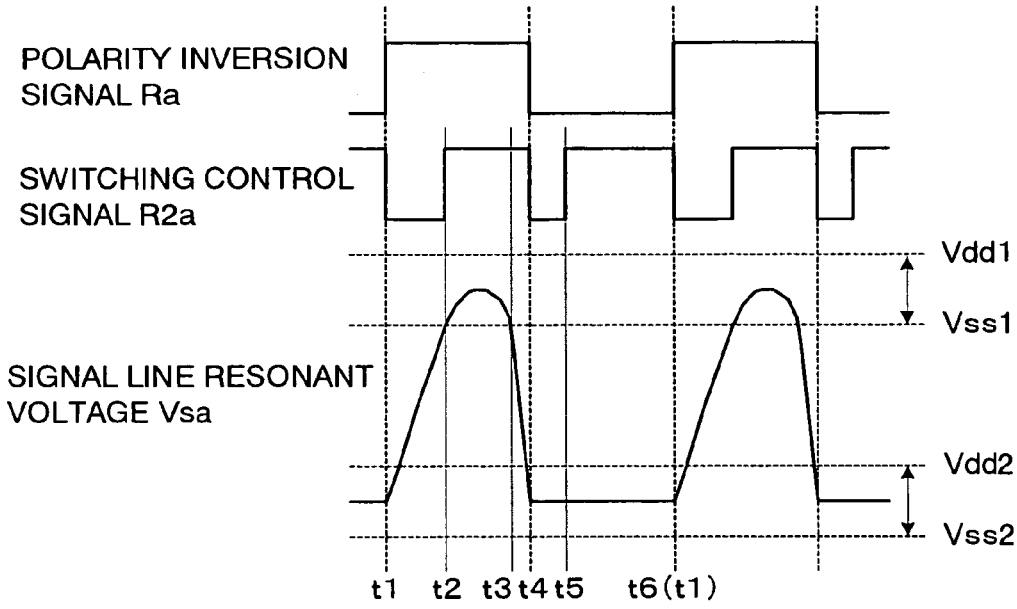
FIG. 9 is a timing chart showing variations with time in the polarity inversion signal and so on in a corresponding manner.

FIG. 9 is a timing chart showing variations with time in the polarity inversion signal Ra, the switching control signal R2*a*, and the signal line resonant voltage Vsa in a corresponding manner. This chart shows the case where the signal line driving circuits 140 and 240 control the voltage within the voltages Vdd1 to Vss1 and the voltages Vdd2 to Vss2.

Figure 10:
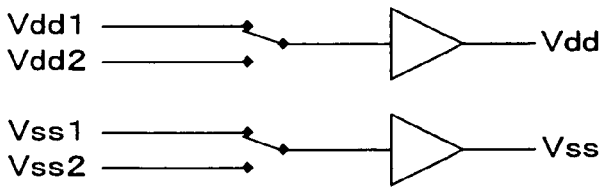
FIG. 10 is a diagram showing a mechanism which switches between power supply voltages of buffer amplifiers.

FIG. 10 is a diagram showing a mechanism which switches power supply voltages of the buffer amplifiers 144 and 244. For each of the power supply voltage Vdd and the ground corresponding voltage Vss, two values are prepared, that is, Vdd1 and Vdd2 and Vss1 and Vss2, respectively which can be simultaneously switched.

It should be noted that a clamp circuit comprising a capacity and a diode can also be employed.

Fourth Embodiment

A fourth embodiment of the present invention will be described.

Figure 11:
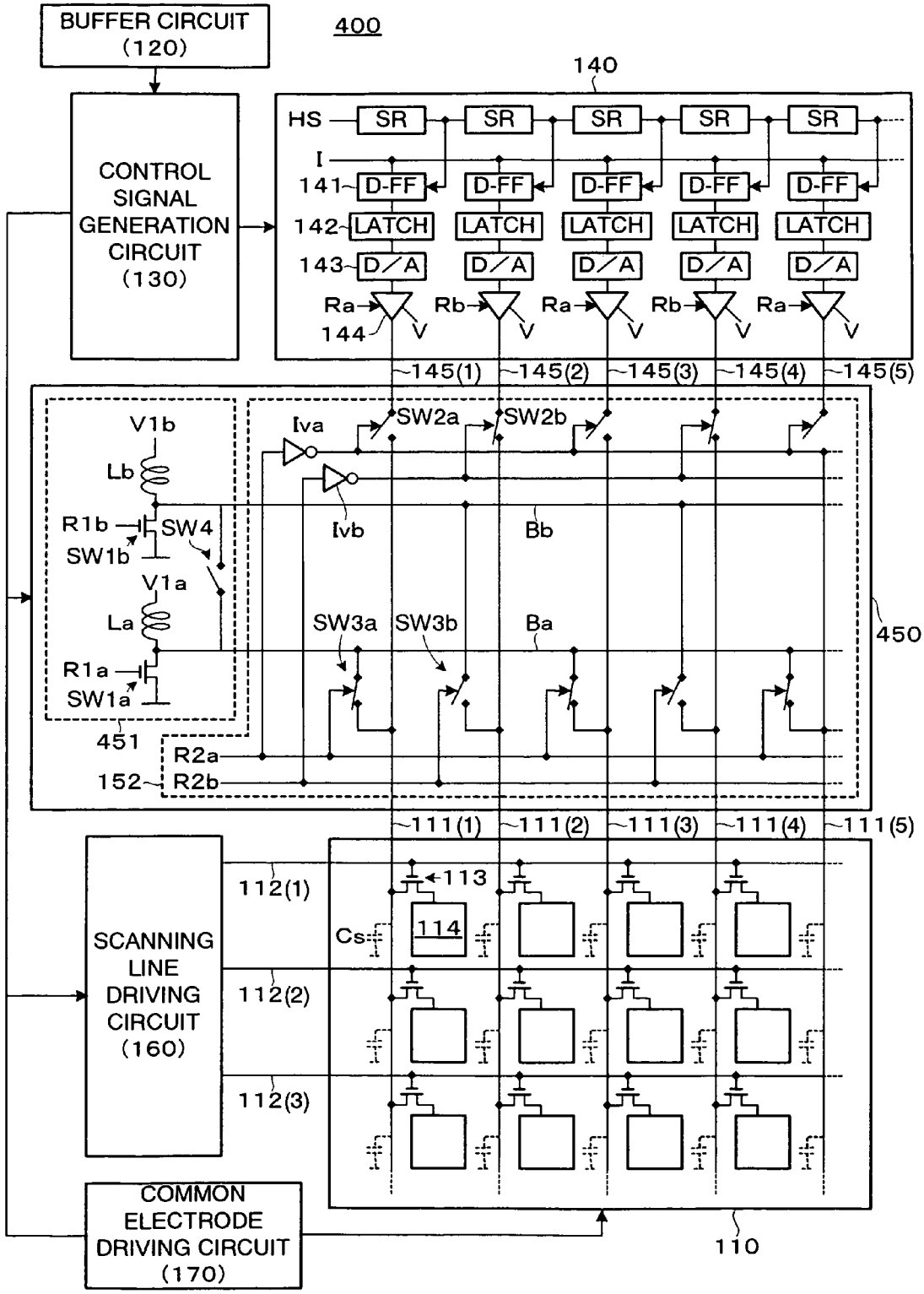
FIG. 11 is a diagram showing a liquid crystal display apparatus according to a fourth embodiment of the present invention.

FIG. 11 is a block diagram showing a liquid crystal display apparatus 400 relating to a fourth embodiment of the present invention. The liquid crystal display apparatus 400 is different from the first embodiment in that a switch SW4 is disposed which connects the inductance elements La and Lb with each other. Other points are basically not different from those of the first embodiment, and therefore detailed description thereof will be omitted.

The switch element SW4 is a switch which short-circuits adjacent signal lines 111 to neutralize inverse polarities of these signal lines 111. After neutralization of the polarities, the signal lines 111 are resonantly driven by the inductance elements La and Lb and then driven by the signal line driving circuit 140.

For example, assuming that a signal with the positive polarity has been written into the signal line 111 (1) and a signal with the negative polarity has been written into the signal line 111 (2) so that charges Q1 and Q2 respectively are held on the capacities C1 and C2 of the respective signal lines 111, turning on the switch element SW4 makes it possible to cancel the charges on the adjacent signal lines (with inverse polarities to each other) 111. This results in prevention of loss of the charges Q1 and Q2 when subsequent driving with inverse polarities is performed to reduce the power consumption.

When inverting the polarity of the signal lines 111 from the positive polarity, the switch element SW4 is turned on to lower the voltage of the signal lines 111 close to 0V. The switch element SW4 is then turned off, and the signal line drive switching circuit 450 lowers the voltage of the signal lines 111 to a minus. Then, the connection of the signal lines 111 is switched to the signal line driving circuit 140, and an accurate signal is written into the signal lines 111.

As described above, driving is divided into three steps, that is, short-circuit between adjacent signal lines 111, resonant driving, and buffer driving in this embodiment.

Fifth Embodiment

A fifth embodiment of the present invention will be described.

Figure 12:
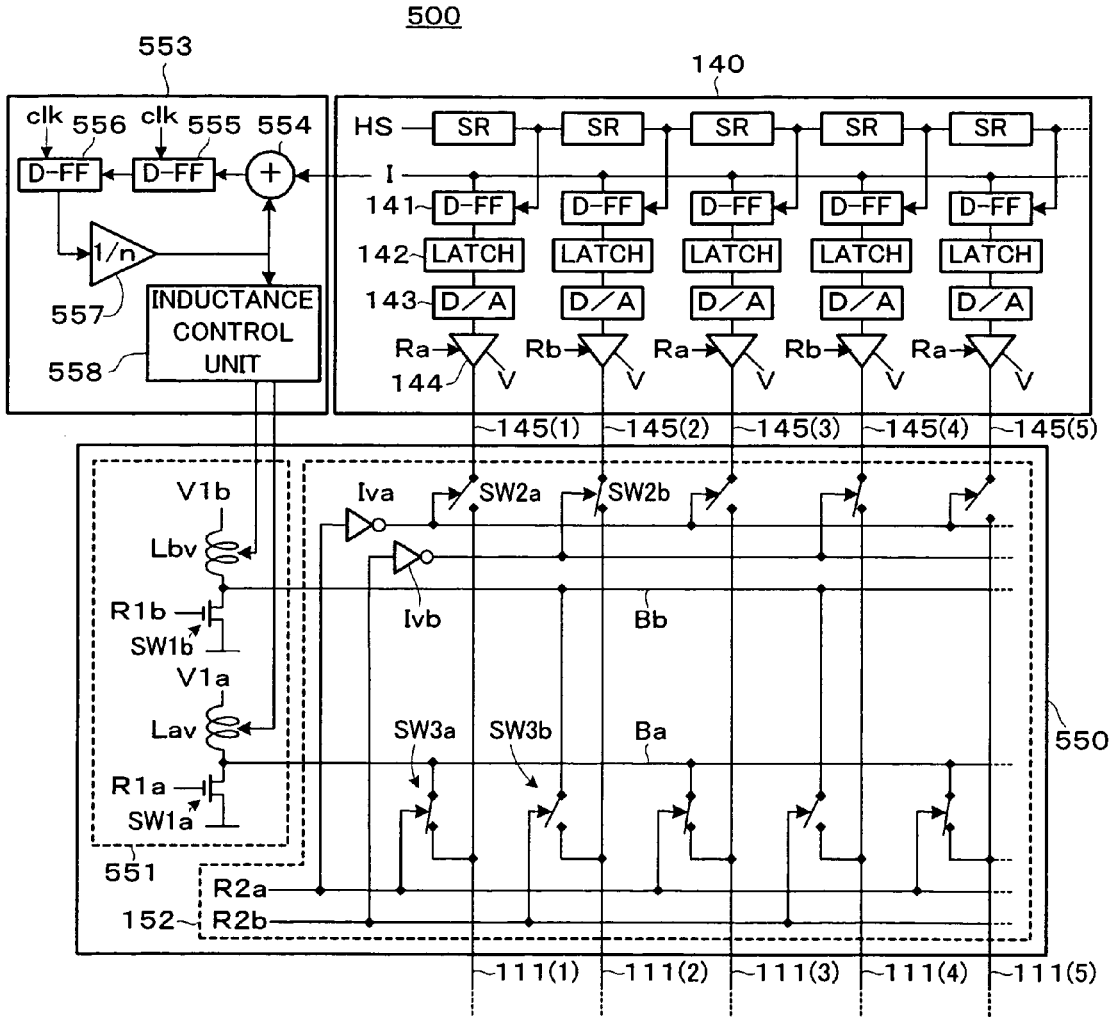
FIG. 12 is a diagram showing a liquid crystal display apparatus according to a fifth embodiment of the present invention.

FIG. 12 is a block diagram showing a liquid crystal display apparatus 500 relating to a fifth embodiment of the present invention. The liquid crystal display apparatus 500 includes a signal line driving circuit 140, a signal line drive switching circuit 550, and an averaging circuit 553.

The liquid crystal display apparatus 500 includes a display unit 110, a buffer circuit 120, a control signal generation circuit 130, a scanning line driving circuit 160, and a common electrode driving circuit 170, which are the same as those of the liquid crystal display apparatus 100, and thus illustration thereof is omitted.

Since the capacities of the signal lines 111 vary depending on the driving voltage, the capacities are detected to vary the inductance amount in the liquid crystal display apparatus 500.

The driving capacity Cse of the signal line 111 is expressed by the following expression.

$$Cse = Csig\text{-gate} + Csig\text{-common} + Csig\text{-pixel}$$

The first term and the third term area cross capacity between the signal line 111 and a scanning line (gate line) 112 and a capacity between the signal line 111 and a pixel electrode 114, which are almost constant irrespective of the driving voltage. The capacity between the signal line 111 and the common electrode at the second term is mostly the capacity of liquid crystal which varies depending on the driving voltage. Liquid crystals differ in dielectric constant between the long axis and the short axis of its molecules, and therefore the liquid crystal capacity varies depending on its direction.

The driving voltage dependent portion vary about 1:1, while the driving voltage non-dependent portion vary about 2:1, so that the capacity varies about 20-30%. Therefore, the resonant frequency can vary to decrease the power consumption reduction effect.

The averaging circuit 553 calculates an average value of the driving voltages and controls the inductance amounts of variable inductance elements Lbv and Lav of the signal line drive switching circuit 550 based on the average value.

The averaging circuit 553 calculates the capacities for the odd-numbered and the even-numbered signal lines 111. This is because the odd-numbered and the even-numbered signal lines 111 have different polarities.

The averaging circuit 553 includes an adder 554, D-FFs (flip-flops) 555 and 556, and an averaging calculator 557.

The averaging circuit 553 receives inputted image signals I and adds them, and the D-FFs 555 and 556 shift them in synchronization with input clocks and hold them such that they are divided into two portions, the odd-numbered portion and the even-numbered portion. The averaging calculator 557 averages the added voltage values. As a result, the respective averages of the voltages of the odd-numbered and the even-numbered signal lines 111 are finally held in the D-FFs 555 and 556.

Depending on a parameter "n", the integration range in the averaging calculator 557 is determined. In other words, the averaging calculator 557 calculates the average value on the number n of the signal lines 111. More specifically, the average calculator 557 cancels values and inputs no value to the adder 554 when the addition in the adder 554 exceeds the number n.

The value "n" is preferably adjusted depending on the response characteristics of the liquid crystal. For example, with the ordinal TN-type liquid crystal, the response speed is low, so that the change of the liquid crystal molecule itself delays about 1 field when the voltage changes. Therefore, the capacity varies on a basis of the average of one filed period. In this case, n is set to ½ of the total number N of the signal lines 111 where averaging shall be performed within one filed period.

Incidentally, it is preferable to set the averaging period shorter for ferroelectric liquid crystal and a bend-mode liquid crystal represented by OCB (Optical Compensated Birefringence) liquid crystal, because they have high response speeds.

An inductance controller 558 controls the inductance elements Lav and Lbv driving the signal lines 111 based on the voltage calculated by the averaging calculator 557 to response to the change in capacity of the liquid crystal. In other words, since the resonant frequency varies according to the change in the capacity of the liquid crystal, the inductance elements Lav and Lbv are controlled in order to perform efficient resonance. The inductance controller 558 increases the inductance amounts of the inductance elements Lav and Lbv when the capacity decreases, and decreases the inductance amounts of the inductance elements Lav and Lbv when the capacity of the liquid crystal increases.

Other Embodiments

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the pixel driving method is not limited to the above-described embodiment, and various kinds of driving methods are applicable as long as they are methods of inversely driving signal lines.

What is claimed is:

1. A liquid crystal display controller, comprising:

a circuit which generates a signal for driving a signal line of a liquid crystal display with a polarity of the signal controlled by a control signal;

an inductance element into which current flows in synchronization with the control signal; and a switching unit which connects selectively one of said inductance element and said circuit to said signal line.

2. The liquid crystal display controller according to claim 1, wherein said switching unit includes a first switch connecting said signal line and said inductance element, and a second switch connecting said signal line and said circuit.

3. The liquid crystal display controller according to claim 1, wherein the liquid crystal display has a plurality of signal lines, said circuit includes a plurality of elements which respectively generate a plurality of signals for driving said plurality of signal lines with polarities of the signals controlled by a plurality of control signals, and said switching unit connects selectively one of said inductance element and each of said plurality of elements to each of said plurality of signal lines.

4. The liquid crystal display controller according to claim 3, wherein said switching unit includes a plurality of first switches respectively connecting said plurality of signal lines and said inductance element, and a plurality of second switches respectively connecting said plurality of signal lines and said plurality of elements.

5. The liquid crystal display controller according to claim 3, wherein each of said plurality of elements includes a first element operating at a first voltage and a second element operating at a second voltage different from the first voltage.

6. The liquid crystal display controller according to claim 3, further comprising:

a calculator which calculates an amount corresponds to an average voltage of the plurality of signals; and an inductance controller which controls an inductance amount of said inductance element based on the amount by calculated said calculator.

7. The liquid crystal display controller according to claim 1, wherein a period during which a signal with a positive polarity is generated by said circuit is longer than a period during which a signal with a negative polarity is generated by said circuit.

8. The liquid crystal display controller according to claim 1, wherein the liquid crystal display has a plurality of signal lines, said circuit includes an element which generates the signal for driving said plurality of signal lines with the polarity controlled by the control signal, a plurality of terminals, and a selecting unit which connects selectively one of said plurality of terminals to said element in synchronization with the control of the polarity by the control signal, and said switching unit connects selectively one of said inductance element and each of said plurality of terminals to each of said plurality of signal lines.

9. The liquid crystal display controller according to claim 1, wherein the liquid crystal display has a plurality of first signal lines and a plurality of second signal lines, said circuit includes a plurality of first elements which respectively generate a plurality of first signals for driving said plurality of first signal lines with said first signals controlled in a first polarity, and a plurality of second elements which respectively generate a plurality of second signals for driving said plurality of second signal lines with said second signals controlled in a second polarity different from the first polarity;

said inductance element includes a first inductance element into which current flows in synchronization with the control of the first polarity, and a second inductance element into which current flows in synchronization with the control of the second polarity; and said switching unit includes a first switching unit which connects selectively one of said first inductance element and said first element to said first signal line, and a second switching unit which connects selectively one of said second inductance element and said second element to said second signal line.

10. The liquid crystal display controller according to claim 1, wherein a difference between a resonant frequency of a combination of said inductance element and said signal line, and a frequency of the polarity control is 25% or less.

11. A liquid crystal display control method, comprising:

generating by a circuit a signal for driving a signal line of a liquid crystal display with a polarity of the signal controlled by a control signal;

flowing a current into an inductance element in synchronization with the control signal; and connecting selectively one of the inductance element and the circuit to the signal line by a switching unit.

12. The liquid crystal display control method according to claim 11, wherein the switching unit includes a first switch connecting the signal line and the inductance element, and a second switch connecting the signal line and the circuit.

13. The liquid crystal display control method according to claim 11, wherein the liquid crystal display has a plurality of signal lines, the circuit includes a plurality of elements which respectively generate a plurality of signals for driving the plurality of signal lines with polarities of the signals controlled by a plurality of control signals, and said connecting includes connecting selectively one of the inductance element and each of the plurality of elements to each of the plurality of signal lines.

14. The liquid crystal display control method according to claim 13, wherein the switching unit includes a plurality of first switches respectively connecting the plurality of signal lines and the inductance element, and a plurality of second switches respectively connecting the plurality of signal lines and the plurality of elements.

15. The liquid crystal display control method according to claim 13, wherein each of the plurality of elements include a first element operating at a first voltage and a second element operating at a second voltage different from the first voltage.

16. The liquid crystal display control method according to claim 13, further comprising:

calculating an amount corresponds to an average voltage of the plurality of signals; and controlling an inductance amount of the inductance element based on the calculated amount.

17. The liquid crystal display control method according to claim 11, wherein a period during which a signal with a positive polarity is generated by the circuit is longer than a period during which a signal with a negative polarity is generated by the circuit.

18. The liquid crystal display control method according to claim 11, wherein the liquid crystal display has a plurality of signal lines, the circuit includes a plurality of terminals, the signal is for driving the plurality of signal lines, the method further comprises applying the signal selectively to one of said plurality of terminals in synchronization with the control of the polarity, and said connecting includes connecting one of the inductance element and each of said plural of terminals to each of said plurality of signal lines.

* * * * *

UNITED STATES PATENT AND TRADEMARK OFFICE

CERTIFICATE OF CORRECTION

PATENT NO. : 7,719,507 B2
APPLICATION NO. : 11/399419
DATED : May 18, 2010
INVENTOR(S) : Okumura et al.

It is certified that error appears in the above-identified patent and that said Letters Patent is hereby corrected as shown below:

Claim 6, column 15, line 51, change "by calculated said calculator." to --calculated by said calculator.--.

Claim 15, column 16, line 57, change "include" to --includes--.

Claim 18, column 18, line 5, change "plural" to --plurality--.

Signed and Sealed this

Seventeenth Day of August, 2010

David J. Kappos

David J. Kappos
*Director of the United States Patent and Trademark Office*